United States Patent [19]

Muller

[11] Patent Number: 4,484,425

[45] Date of Patent: Nov. 27, 1984

[54] ANCHORAGE OF CABLES

[75] Inventor: Jean N. Muller, Tallahassee, Fla.

[73] Assignee: Figg and Muller Engineers, Inc., Tallahassee, Fla.

[21] Appl. No.: 400,266

[22] Filed: Jul. 21, 1982

[51] Int. Cl.[3] ..... E04C 3/10

[52] U.S. Cl. ..... 52/223 R; 52/230; 14/22

[58] Field of Search ..... 52/223 R, 223 L, 230, 52/741; 14/21, 22, 23; 24/122.3

[56] References Cited

U.S. PATENT DOCUMENTS

| | | | |
|---|---|---|---|
| 2,127,235 | 8/1938 | Robinson . | |
| 2,763,464 | 9/1956 | Leonhardt | 52/230 X |
| 2,867,884 | 1/1959 | Brandt . | |
| 2,914,783 | 12/1959 | Hoyden et al. . | |
| 3,412,511 | 11/1968 | Dietrich . | |
| 3,475,777 | 11/1969 | Robinson . | |
| 3,548,432 | 12/1970 | Durkee et al. . | |
| 3,554,492 | 1/1971 | Beghi . | |
| 3,778,869 | 12/1973 | Andrews | 52/223 L X |
| 3,803,785 | 4/1964 | Finsterwalder et al. | 24/122.6 X |
| 3,864,776 | 2/1975 | Hedefine et al. . | |
| 3,919,762 | 11/1975 | Borelly . | |
| 3,975,476 | 8/1976 | Finsterwalder . | |
| 4,117,582 | 10/1978 | Borelly . | |
| 4,223,495 | 9/1980 | Peter . | |
| 4,235,055 | 11/1980 | Schambeck . | |

*Primary Examiner*—Carl D. Friedman

*Attorney, Agent, or Firm*—Watson, Cole, Grindle & Watson

[57] ABSTRACT

An anchorage for a support cable of a bridge construction includes an anchorage block for anchoring one end of the cable relative to a structural bridge component, the block including anchor heads and hollow tubes extending in registry with anchor head passages at one end of wall of the block and terminating at an opposite end wall of the anchorage block. The cable includes a tubular sheath seated against the anchorage block and extending through its bearing plate as well as through a bearing plate on the bride component. Cable strands are threaded through the sheath and through the hollow tubes as well as through the anchor head passages, and the cable strands are simultaneously stressed by means of hydraulic stressing jacks operating between the bearing plates.

6 Claims, 4 Drawing Figures

11
10
12
28
48
36
36
29
31
32
44
39
38
35
33
19
20
41
42
43
4
4
18
24
32
26
34
13
25
25
15
15
16
17
21
22
37
36
47
46
21
21
27
23
21
21

ANCHORAGE OF CABLES

BACKGROUND OF THE INVENTION

This invention relates generally to a cable anchorage for a bridge construction, and more particularly to such an anchorage which facilitates the tensioning of the cable extending through a structural bridge component such as a cantilevered segment of a cable-stayed girder bridge.

The deck girder of such a cable-stayed girder bridge is sequentially constructed as successive adjacent deck sections are cantilevered from previously supported sections. A movable form carrier may be utilized for supporting each successive deck section during its formation. The bridge is supported from pylons or towers extending upwardly from the bridge piers, and straight cables extend obliquely from the pylons to longitudinal stiffening girders of the deck girder sections. The cables lie in vertical or inclined planes along opposing side edges of the deck girder, or in a single vertical plane along the longitudinal axis of the bridge. The ends of the cables are anchored to the stiffening girders, and are tensioned prior to the formation of each successive deck section.

Otherwise, the deck girder sections may be precast and transported to the bridge site. The cable stays are likewise anchored in place.

Thus, after the tension members of the cable, comprising a plurality of strands, tendons, wires or the like, are stressed, and restressing thereof due to subsequent changes in stressing requirements, is difficult to carry out at the anchorage block end. Cable restressing may be carried out at the tower end of the cable, but is tedious and time-consuming leading to long bridge use downtimes which present unbearable problems. Besides, it is impractical and unduly burdensome to easily replace cable stays when the need arises.

SUMMARY OF THE INVENTION

It is therefore an object of the present invention to provide a cable anchorage which is simple and economical to fabricate yet is highly effective in anchoring the end of a support cable which extends through a structural bridge component such as a deck girder section of a cable-stayed girder bridge, the anchorage including a shiftable anchorage block capable of being jacked away from a bearing surface of the bridge component for simultaneously stressing the tension members of the cable.

Another object of this invention is to provide such a cable anchorage in which the block includes hollow tubes extending from passages of anchor heads located at one end of the block and terminating at an opposite end of the anchorage block, the cable strands being threaded through a cable sheath as well as through the hollow tubes and the passages. A confronting end of the sheath is seated against the anchorage block, and the block is maintained temporarily spaced apart from a bearing plate of the structural bridge component while the cable strands are anchored to the anchor heads and are individually jack stressed for prestressing the strands. The anchorage block is thereafter shifted in a direction away from such bearing plate for simultaneously stressing the cable strands, and permanent shims or the like are set between the block and the bearing plate.

A further object of this invention is to provide such an anchorage wherein the inside of the sheath is filled with an initially flowable and hardenable material for embedding the cable strands therein, and an anchorage tube surrounds the sheath between the bridge component and the anchorage block so as to form an annular space which is filled with an initially flowable, hardenable material.

Other objects, advantages and novel features of the invention will become more apparent from the following detailed description of the invention when taken in conjunction with the accompanying drawings.

DETAILED DESCRIPTION OF THE INVENTION

Figures 1, 2:
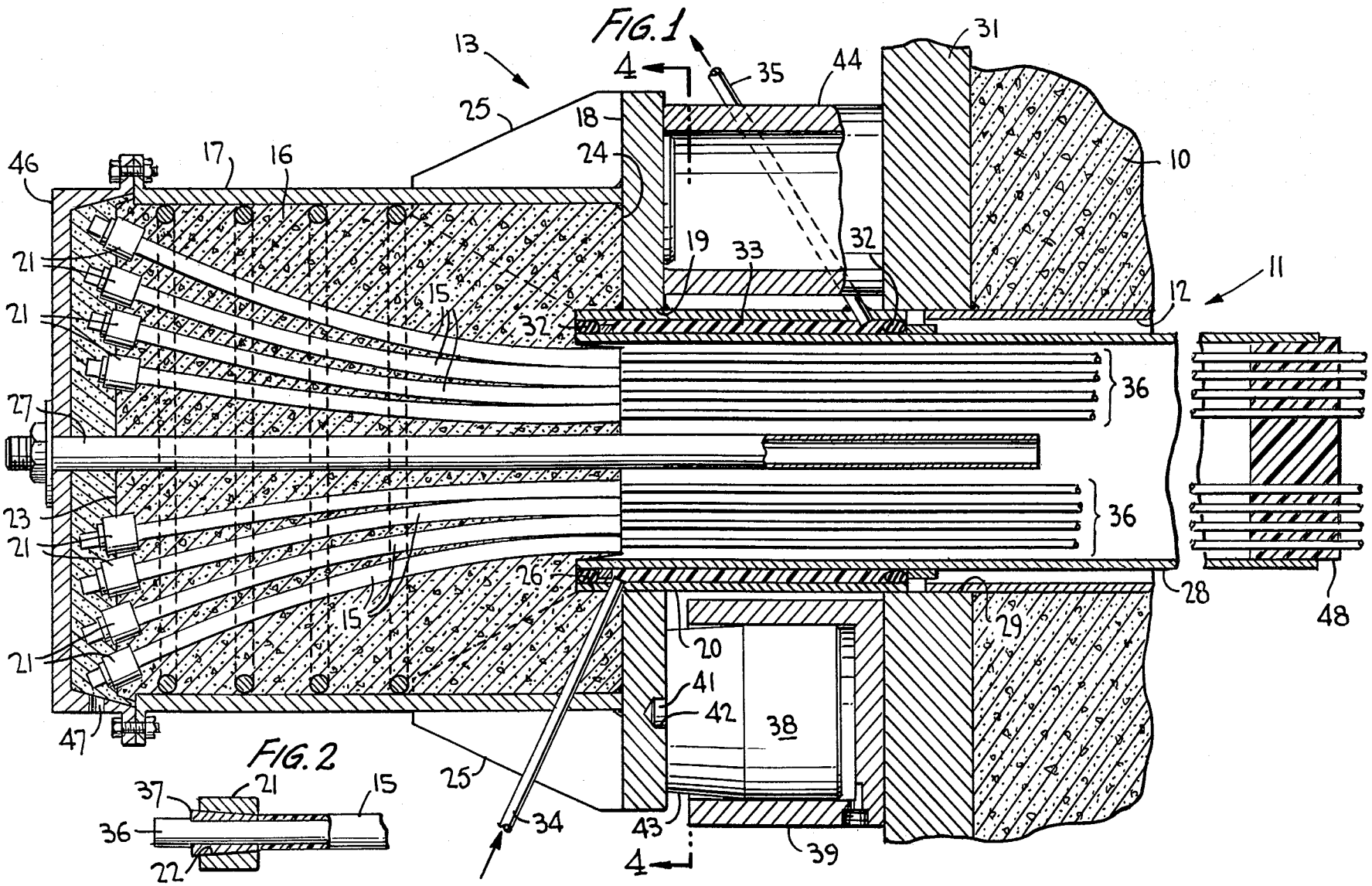
FIG. 1 is a cross-sectional view of the cable anchorage according to the invention.
FIG. 2 is a sectional, detail view of a typical anchor head and cooperating wedge clamp for the individual cable strands.
Figure 3:
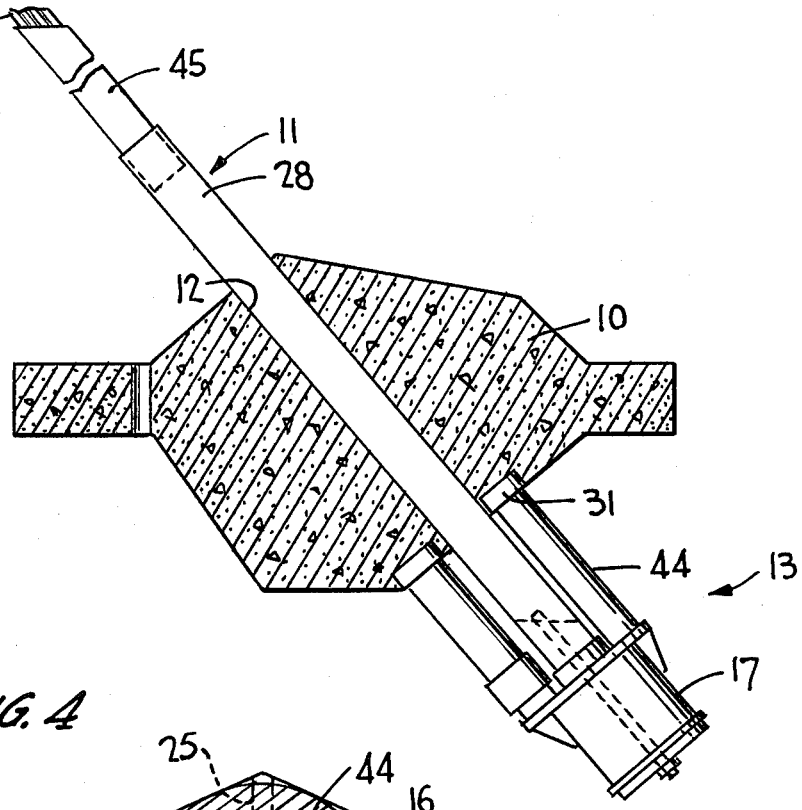
FIG. 3 is a side view, at a reduced scale, of a cable stay anchored according to the invention and supporting a deck girder section of a cable-stayed girder bridge.
Figure 4:
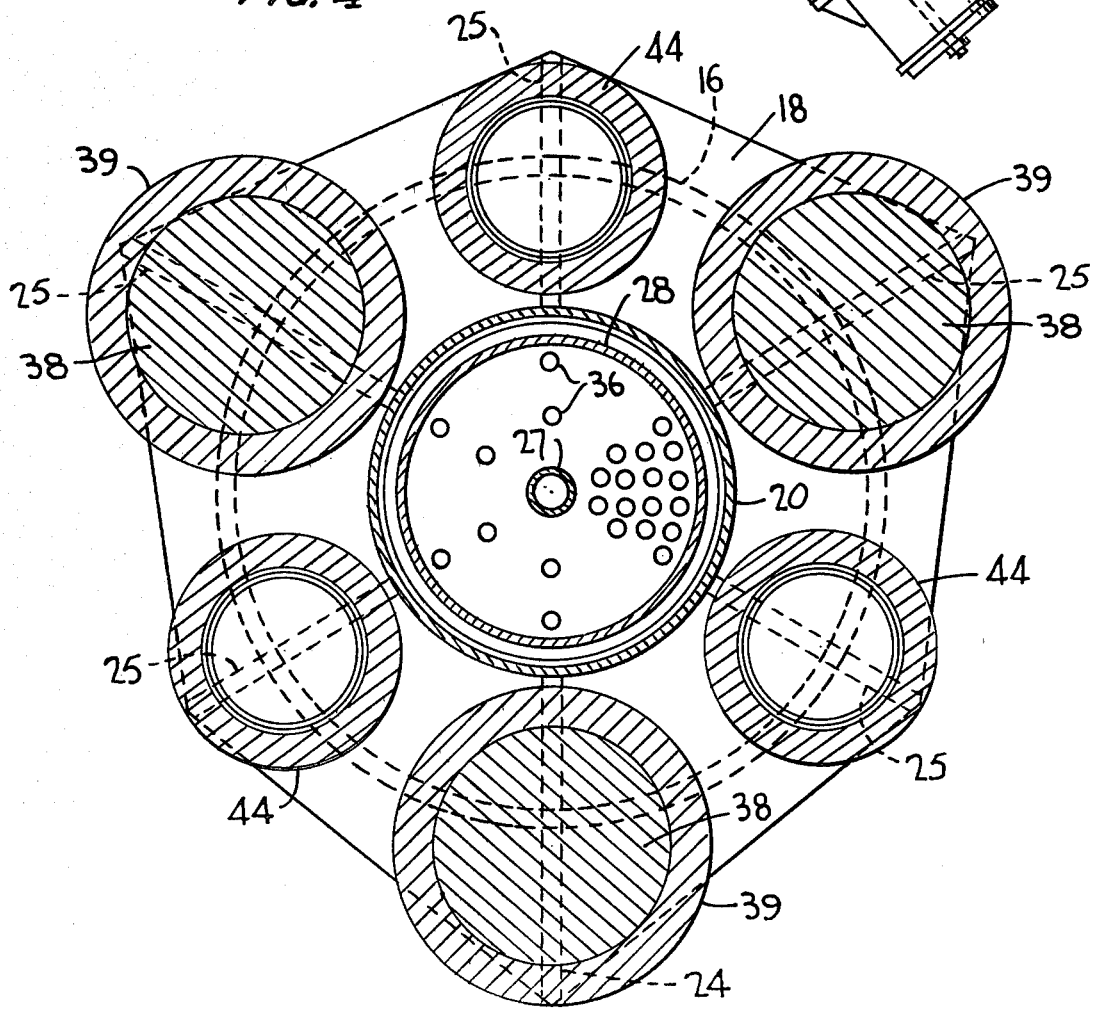
FIG. 4 is a cross-sectional view taken substantially along the line 4—4 of FIG. 1.

Turning now to the drawings wherein like reference characters refer to like and corresponding parts, the cable anchorage shown in detail in FIG. 1 is more generally shown in FIG. 3 as it relates to a structural bridge component 10 which forms the central portion of a deck girder section of a cable-stayed girder bridge which may be of structural steel or concrete. Lateral deck segments (not shown) extend from opposite sides of the centrally disposed bridge component 10. A support cable, generally designated 11, extends obliquely from the bridge pylon or tower (not shown) and through an opening in the bridge component covered by a casing 12. The lower end of the cable is anchored by an anchorage block assembly 13.

Before the cable stay is anchored in its FIG. 1 position to be described hereinafter, assembly 13 is formed by precasting and is transported to the bridge site. To form the anchorage, a plurality of hollow tubes 15, which may be of a suitable plastic material, are embedded within a block 16 of concrete and, during block formation, are anchored at opposite ends by suitable templates (not shown). A shell 17 functions as a side wall, and a plate 18 serves as a bottom wall together with a bottom template during anchorge block formation. Plate 18 has a central opening 19 through which an anchorage tube 20 extends. A plurality of anchor heads 21, having outwardly open conical passages 22 (FIG. 2) extend outwardly of an end wall 23 of the block and are partially embedded therein during the forming process. The anchor head passages are maintained in registry with the hollow tubes by some suitable plug arrangement during the block forming process, and the passages are spaced apart in a predetermined pattern. At an opposite end wall 24 of the anchorage block, tubes 15 are maintained in contacting relationship during the block forming process, and the tubes terminate at wall 24 with their transverse axes lying in a plane perpendicular to the central axis of the anchorage block. Tubes 15 are therefore slightly curved between opposite ends of the anchorage block and, after concrete 16 is cured, are solidly embedded in the block.

Plate 18 defines a bearing plate for the anchorage block, and remains secured to shell 17 after the mortar block cures. Spaced gusset plates 25 attached to plate 18 are embedded in the anchorage block may be provided to improve upon the structural integrity of the block at its bearing surface, and an annular groove 26 is formed at wall 24 of the block. A hollow fill tube 27 extends coaxially of the anchorage block and extends into a hollow cable sheath 28. As seen in FIGS. 1 and 3, this sheath extends through casing 12 of bridge component 10, through an opening 29 of a bearing plate 31 of the bridge component and into an anchorage tube 20 until its end is seated within annular groove 26. Sheath 28 is of a smaller diameter compared to tube 20 so as to define an annular space therewith. Spaced seal rings 32 are provided on the sheath to close the annular space formed with the anchorage tube for the reception of an initially flowable, hardenable material such as a resin 33 filled through a tube 34 and vented through a tube 35. The anchorage tube and the sheath are thus bonded together in the area between bearing plates 18 and 31.

Thereafter, strands or wires 36 of cable 11 are threaded through the upper open end of sheath 28 and individually through tubes 15 as well as through passages 22 of the anchor heads. Tapered keys 37 are then inserted between the strands and the anchor head (FIG. 2) and temporary shims (not shown) are disposed between plates 18 and 31 for maintaining them at a predetermined spaced apart distance. All the strands are then stressed individually by about 20% of their force using a mono strand jack of known construction. Preferably, individual stressing is carried out starting with the centermost strands and proceeding in circles to the outermost strands The temporary shims are then successively removed and replaced by three hydraulic jacks each comprising piston and cylinder units 38, 39. Each piston has a peg 41 engageable in a recess 42 provided in the outer face of plate 18, for immobilizing the piston in place. And, the outer extension of each piston is inwardly tapered as at 43 to permit cocking of the piston relative to its cylinder to accommodate any non-parallel relationship between plates 18 and 31 during the process of operating the hydraulic jacks. The cable strands are thus simultaneously stressed as the pistons of the hydraulic pressing jacks are extended out of their cylinders to thereby shift bearing plate 18 further apart from bearing plate 31. Since the piston stroke is less than the cable stay elongation, the stressing operation will be carried out in several steps, with intermediate shimming tubes being cut to the proper dimension at each step. When a final predetermined stressing of the cables is reached, permanent shims 44 are disposed between bearing plates 18 and 31 for fixing them at the final spaced apart distance. Hydraulic pressure utilized in operating the stressing jacks may then be released, and the jacks may be removed.

It should be pointed out that, during the aforedescribed cable stressing operation, the anchorage block, anchorage tube and sheath 28 bonded thereto are shifted relative to bearing plate 31, and the holding forces at the anchor heads are transmitted back to bearing plate 31 for simultaneously stressing the cable strands.

Sheath 28 extends outwardly of component 10 a predetermined distance (FIG. 3), and a sleeve 45 may be provided outwardly thereof encasing the cable strands and telescoping into the upper end of the sheath. A grouting cap 46 is mounted on the free end of shell 17 and is filled via a fill opening 47 with a suitable epoxy compound so as to intimately surround the exposed ends of the cable strands and the anchor heads. The inside of sheath 28 is then filled from below via tube 27 with a suitable epoxy compound and/or mortar mix so as to fill all the voids between the cable strands within the sheath and to fill any spaces between the cable strands and tubes 15. If sleeve 45 is not used, sheath 28 may be capped by means of a template 48.

From the foregoing, it can be seen that the cable strands of the cable stay are capable of being stressed simultaneously as the anchorage block is shifted away from a bearing plate 31 of the central portion 10 of a deck girder section in a manner whereby the cable may be subsequently restressed by the simple operation of the piston and cylinder units located between bearing plates 18 and 31. The anchorage block construction permits the cable strands, upon assembly, to be threaded through the cable sheath and through the hollow tubes which are so arranged at end wall 24 of the anchorage block as to avoid the need for any fairleads or the like since the strands are disposed in mutually parallel relationship within the sheath outwardly of end wall 21. The cable sheath may be completely filled with a grouting for stability and for inhibiting rust and corrosion of the strands by isolating them from the atmosphere. And, the anchorage block is completely enclosed after its end cap is filled with grouting.

Moreover, when the need arises, the cable stay may be easily removed for replacement by simply uncoupling the cable stay from the tower, and lowering the anchorage block assembly so as to slide the cable sheath out through casing 12.

Obviously, many modifications and variations of the present invention are made possible in the light of the above teachings. For example, the anchorage block assembly may be utilized for anchoring the main cable of a suspension bridge relative to a fixed concrete bridge support. It is therefore to be understood that within the scope of the appended claims the invention may be practiced otherwise than as specifically described.

What is claimed is:

1. In a bridge construction having support cable means including a plurality of tension members, an anchorage system for anchoring one end of said cable means relative to a structural bridge component and for simultaneously tensioning said members, said cable means extending through an opening in said bridge component, a concrete anchorage block, anchor heads having a plurality of spaced passages extending outwardly of one end wall of said block, a plurality of hollow tubes in registry with said passages extending therefrom and terminating at an end wall of said anchorage block lying opposite said one end wall, said tubes being in mutual contact at said opposite end wall, a first bearing plate lying against said opposite end wall and having a central opening, said tension members extending through said tubes and through said passages, means securing said tension members to said anchor heads, a tubular sheath extending from said opposite end wall through said central opening of said first bearing plate and encasing said tension members, a second bearing plate having a central opening through which said sheath extends and bearing against said structural bridge component, said bearing plates being in spaced apart parallel relationship, extendable means acting between said bearing plates for spacing them a predetermined distance apart to thereby simultaneously tension said members as said anchorage block is shifted away from said second plate, and a plurality of spacers having a length equal to said predetermined distance being disposed between said plates for maintaining said predetermined distance.

2. The system according to claim 1, further comprising a hollow fill tube coaxially extending through said anchorage block and terminating inside said sheath for filling said sheath with an initially flowable, hardenable material to embed said tension members therein.

3. The system according to claim 1, further comprising an anchorage tube mounted on said first bearing plate, said tube surrounding said sheath at a spaced apart distance and extending between said bearing plates, seal means between said tube and said sheath at opposite ends of said tube, and an initially flowable, hardenable material occupying the space between said tube and said sheath.

4. A method of anchoring one end of a support cable means and for tensioning the tension members thereof relative to a structural bridge component of a bridge construction, comprising the steps of forming a concrete anchorage block with a plurality of hollow tubes embedded therein and with a plurality of anchor heads in registry with said tubes and extending outwardly of the end wall of said block, said anchor heads having passages spaced apart in a predetermined pattern and said tubes extending from said passages and terminating at an end wall of said block lying opposite said one end wall, said tubes at said opposite end wall lying in mutual contacting relationship in said predetermined pattern, extending a tubular sheath through an opening in said bridge component, threading said tension members through said sheath, said hollow tubes and said passages, seating said block against a confronting end of said sheath, temporarily maintaining confronting bearing surfaces on said block and said component in parallel spaced apart relationship and perpendicular to the central axis of said sheath, securing ends of said tension members to said anchor heads and temporarily stressing said members while said bearing surfaces are maintained in said spaced apart relationship, moving said bearing surfaces apart a predetermined distance for simultaneously applying a predetermined stressing force to said tension members, and fixing said bearing surfaces apart at said predetermined distance.

5. The method according to claim 4, further providing an anchorage tube on said block extending outwardly of said opposite end thereof and being of a larger diameter then said sheath and surrounding same when said block is seated against said confronting end of said sheath, and filling the space between said tube and said sheath with initially flowable, hardenable material.

6. The method according to claim 4, further filling the inside of said sheath with initially flowable, hardenable material through said anchorage block, after said moving step, for embedding said tension members in said material.

* * * * *